United States Patent [19]

Tschudin-Mahrer

[11] Patent Number: 4,867,271

[45] Date of Patent: Sep. 19, 1989

[54] ACOUSTIC INSULATION BOARD CONSISTING OF FOAM

[75] Inventor: Rolf Tschudin-Mahrer, Lausen, Switzerland

[73] Assignee: Irbit Research & Consulting AG, Fribourg, Switzerland

[21] Appl. No.: 139,610

[22] Filed: Dec. 30, 1987

[30] Foreign Application Priority Data

Jan. 7, 1987 [DE] Fed. Rep. of Germany ... 8700264[U]

[51] Int. Cl.[4] ..... E04B 1/82

[52] U.S. Cl. ..... 181/290; 181/286; 181/294

[58] Field of Search ..... 181/207, 208, 284, 290, 181/294, 286, DIG. 1

[56] References Cited

U.S. PATENT DOCUMENTS

| | | | |
|---|---|---|---|
| 3,833,086 | 9/1974 | Giraudeau | 181/207 |
| 4,242,398 | 12/1980 | Segawa et al. | 181/290 X |
| 4,273,213 | 6/1981 | Munz | 181/207 |
| 4,281,739 | 8/1981 | Keiser | 181/207 |
| 4,493,471 | 1/1985 | McInnis | 181/208 X |
| 4,705,139 | 11/1987 | Gahlau et al. | 181/290 |

*Primary Examiner*—B. R. Fuller

*Attorney, Agent, or Firm*—Martin A. Farber

[57] ABSTRACT

An acoustic insulating board of foam with structured bulge-forming surface in the form of regions (I, II) of different thickness. In order to obtain differing acoustic efficiency, the acoustic insulating board comprises plurality of individual boards (1) arranged one above the other, which boards are compressed in the regions (I) of lesser thickness and are fused together on their surface. In the regions (II) of larger thickness, the boards lie loosely on one another so that a top side facing in the direction of the structural bulging of a central individual board (1) is profiled in the regions of greater thickness.

3 Claims, 4 Drawing Sheets

ACOUSTIC INSULATION BOARD CONSISTING OF FOAM

FIELD AND BACKGROUND OF THE INVENTION

The present invention relates to an acoustic insulation board consisting of foam having a structured bulge-forming surface in the form of regions of different thickness.

By selection of a given surface structure and regions of different thickness, the acoustic efficiency can be changed and, in particular, adapted to specific frequency ranges. As structure-forming means, thermal deep-drawing is generally employed.

SUMMARY OF THE INVENTION

The object of the invention is to make known with easily produced means, on the one hand, an additional factor for varying the acoustic efficiency in order to arrive at an even better individualization while, on the other hand, to be able better to overcome, from a support standpoint, greater differences in height of the bulges.

According to the invention the board is made of a plurality of individual boards (1) place one above the other, which are compressed in the regions (I) of smaller thickness and fused on the surface to each other, while in the regions (II) of larger thickness they lie loosely on top of one another in the manner that the top side facing in the direction of the structure bulting of a central individual board (1) is profiled in the regions of greater thickness.

As a result of this development, an acoustic insulation board or absorption board of this type which is of optimally adjustable acoustic efficiency is obtained. The attaching of the individual boards is effected without the use of adhesive and therefore with substantial retention of the homogeneity. Manufacture is simplified and accelerated. The expense for apparatus is also less. As means of individual equipment there can no also be used materials which normally could not find any use up to now in hot-forming methods. Such materials can now be included as intermediate layers of workable property. In addition to the advantage of the practically sandwich-like construction or laminated layers, there are possibilities of variation due to the use of differently strucured foam structures, such as coars and fine foam, foams of different unit weight, etc. With maximum spacing effect of the central profiled individual board, a relatively small accumulation of material results due to the thermal leveling. In addition to this, there is also an advantageously usable factor inasmuch as practically flat air chambers remain between thenon-bound parts of the individual boards. In this connection, it is found favorable that the top side, facing in the direction of the structural bulging of a central individual board, is profiled in the regions of greater thickness.

The corresponding profiling makes possible, with small volume, a large total thickness of acoustic insulating boards. The profiled individual board, however, is prepared excellently in view of the surface-melting effect; its camber is practically leveled-out upon a thermal deep-drawing. In the region of the bulges the profiling acts as support structure between the next individual board which extends free over the tips of the profile and the board lying at the back. In the transition regions to the deepened zones, the cambering decreases accordingly. In this connection, it is found advantageous for the profiling of the individual board to consist of ribs/-grooves combined in fields which lie in each case crosswise to each other. It is favorable in this connection for these fields ot be squares. This results in ribs of equally justified load-carrying capacity. Finally, it also proves advantageous that a transition zone in the form of an oblique flank be arranged between the two regions of a transition zone. such an oblique flank creates a pregnant, durable transition zone between the regions.

BRIEF DESCRIPTION OF THE DRAWINGS

With the above and other objects and advantages in view, the present invention will become more clearly understood in connection with the detailed description of a preferred embodiment when considered with the accompanying drawing, of which.

DETAILED DESCRIPTION OF THE PREFERRED EMBODIMENT

The body K which is developed as an acoustic insulating board or sound abosrption board consists of a plurality of individual boards (board elements) 1 of open-pore soft foam.

Figure 1:
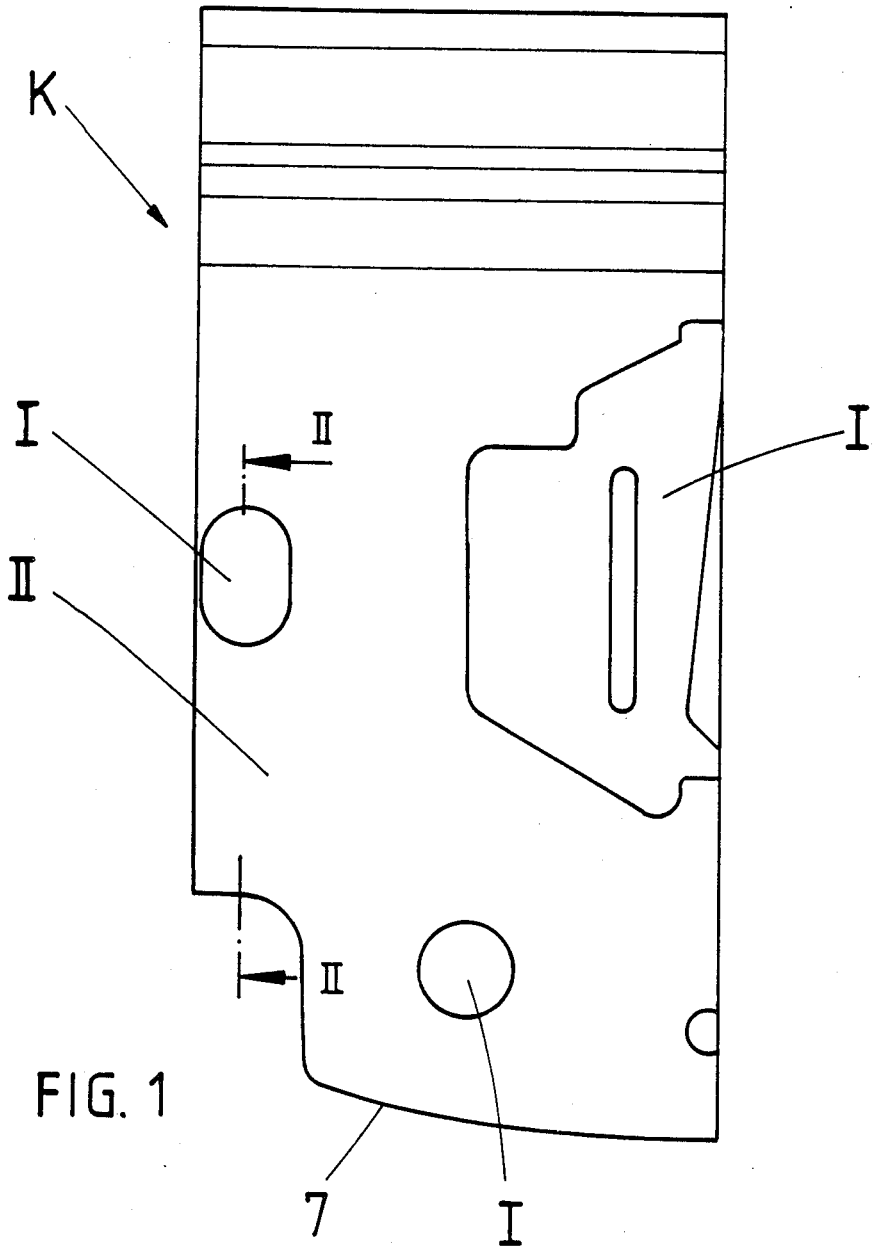
FIG. 1 is a top view of a portion of an acoustic insulating board developed in accordance with the invention.
Figure 2:
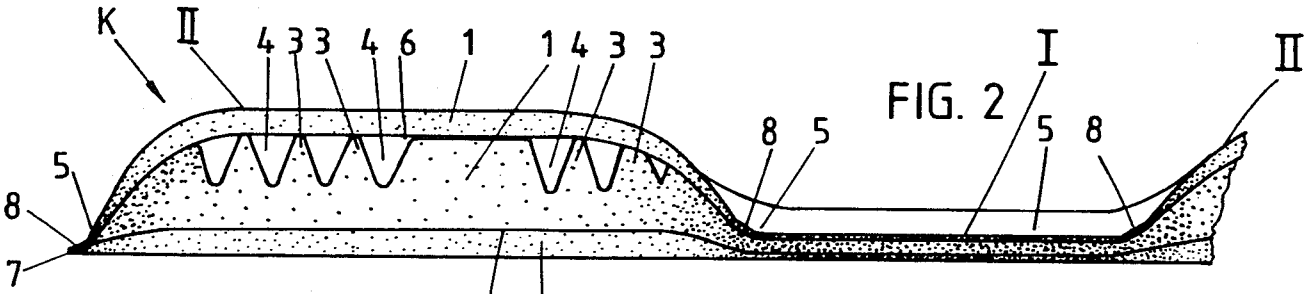
FIG. 2 is a section along the line II-II of FIG. 1, in approximately true size.

The body K is structured on one side, as can be noted from FIG. 2. The structuring is effected under the action of heat and pressure in a hot mold, not described in detail.

The other side of the body K which faces away from the structure-forming bulges is basically flat.

The structured shape takes into consideration the shaping necessary for the purpose of use. This can, of course, vary greatly.

Figure 4:
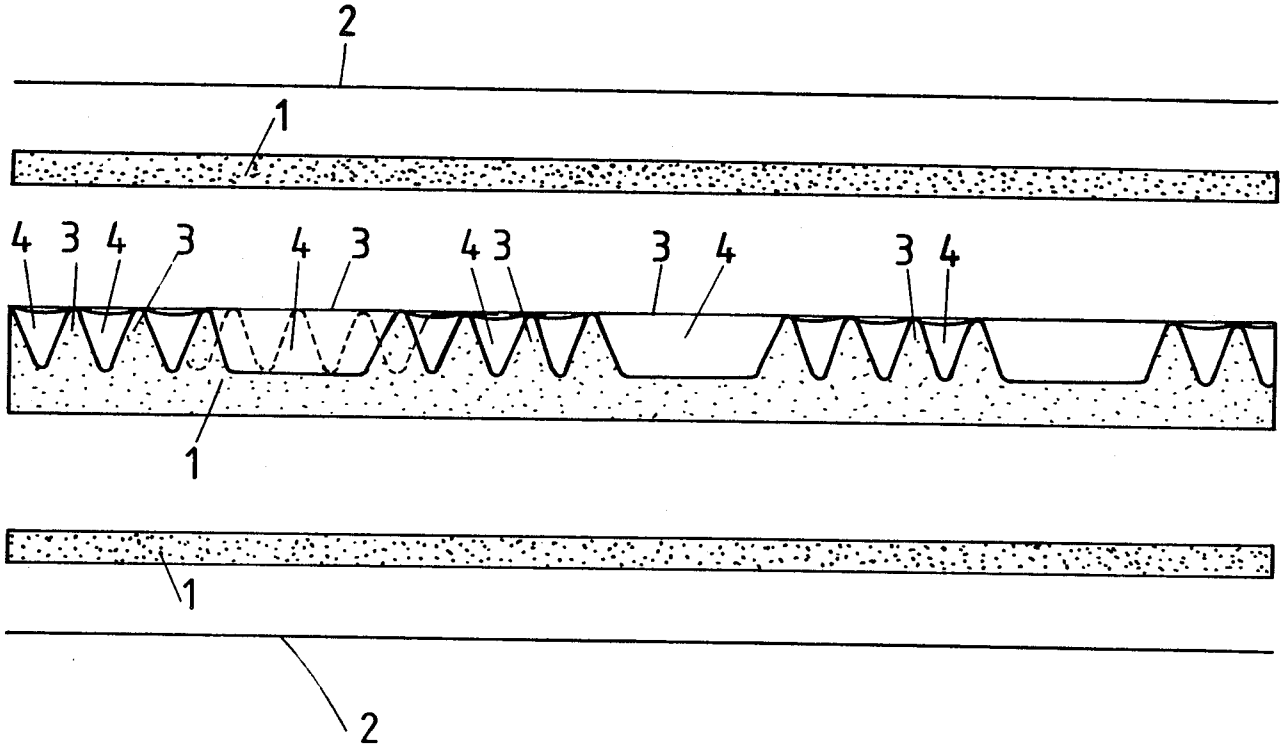
FIG. 4 shows the individual boards in separated condition.

In the embodiment shown, the two outer individual boards 1 of a total of three individual boards used have the same initial thickness. In the embodiment shown, this is about 5 mm. The intermediate individual board 1, on the other hand, has several times, for instance four times, the initial thickness. All the individual boards 1 can be boards of different pore thickness and furthermore of a density which varies with the material. The individual boards 1, which by nature extend out flat,as can be noted from FIG. 4, are loosely placed one above the other to form a laminate. The upper and lower closures can furthermore be formed by a thermally responsive foil 2. The latter lead, on the final heat-deformed body K, to the formation of a skin which prevents the penetration of moisture. With the use of the hot mold, the corresponding formation of the skin can in this connection also be obtained by closing the surface of the outer individual boards 1 which face the inside of the mold. The edges of the outer pores of the foam structure are thereby pulled together. This takes place to such an extent that a certain perviousness to air and sufficient perviousness to sound is still present.

Figure 5:
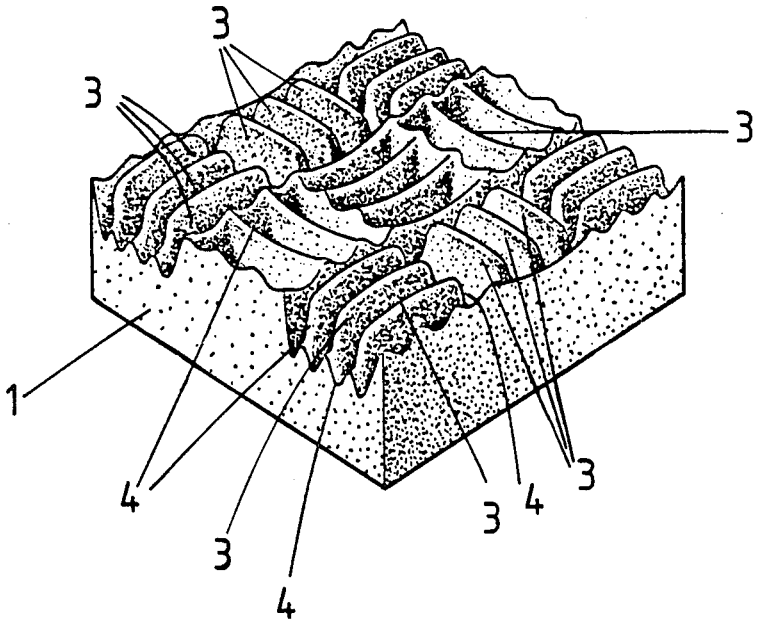
FIG. 5 is a perspective block diagram of a portionof the profiled individual board.

The central individual board 1 has a uniform profiling on its top side facing in the direction of the structural bulging. This rather bizarre profiling extends over the entire top side. It consists or protruding ribs 3 combined inindividual fields, leaving deep-cut notch-like grooves 4 between them. The direction of the individual groups of ribs and groups of valleys is such that the ribs 3 and the valleys 4 of one field extend transversely to the ribs 3 and valleys 4 of all adjacent fields present at its sides. Referred to the total thickness of the central individual board 1, about two-thirds of the total initial thickness devolves upon the profiling. The flank angle of the ribs or grooves is 13° to 30°. As can be noted from the diagram of the block in FIG. 5, free-standing ribs 3 alternate with ribs which are transversely connected on their end, so that the intermediate grooves 4 are not open at the end. This type of board can be produced without loss by the use of a central cut. For this purpose the relief structure is produced by deformation projections to be introduced from the outside at the wide surface on both sides, staggered with respect to the central sectional plane, as a result of a different degree of compressing. After leaving the cutting region , the zones of compression become erect again so that alternately troughs and projections or ribs and grooves appear. In this way one has a positive/negative product, the appearance of which is, however, uniform.

Upon the thermal deep-drawing of the stack of individual boards, regions of different body thickness are formed. In the regions I of lesser thickness, the individual boards 1 are compressed permanently to a fraction of their initial thickness and surface-melted to each other. Adhesive can therefore be dispensed with. As a result of the open-pore nature of the material, the adherence bond is favored. For example, exposed structure parts of the foam structure engage into the open pores of, in each case, the other layer. This leads even to an interhooked engagement, comparable to a socalled 'velcro fastener.'

In the regions II of greater thickness the individual boards 1 lie loosely on one another except in the transition zones. Reference is had to FIG. 2. The compressing has been made also optically clear in the manner that the compressed regions I and the transition zones to the non-compressed portions of the individual boards 1 have a greater density of dots.

As a result of the merely loose superimposing of the individual boards 1 in the regions II of greater thickness, air chambers 6 remain in actual practice. Such air chambers are correspondingly larger in volume in the boundary region between the top side of the central individual board 1 facing the bulging and the corresponding inner side of the outer individual board 1 present there, as a result of the grooves 4, as a function of the degree of compression. The outer individual board 1 rests on the transversely rounded crests of the ribs 3. With increasing leveling in the transition region to the deeper lying compressed regions I the volumes of the hollow spaces decrease accordingly.

The compressed region I appears as a closing rim 7, at least in the edge region of the body K. The thickness there in the peripheral end zone is about 1 mm.

Although in the embodiment shown the broad side of the body K facing away from the bulging is flat, it is nevertheless possible from this side to develop depressions which lie in the direction of the bulging so that not only does the cushion-like bulging result but, for example, also a shift in flatness of a compressed region. These are all measures for the individual adaptation or accommodation of the acoustic insulating board to sources of noise of different frequency.

Figure 3:
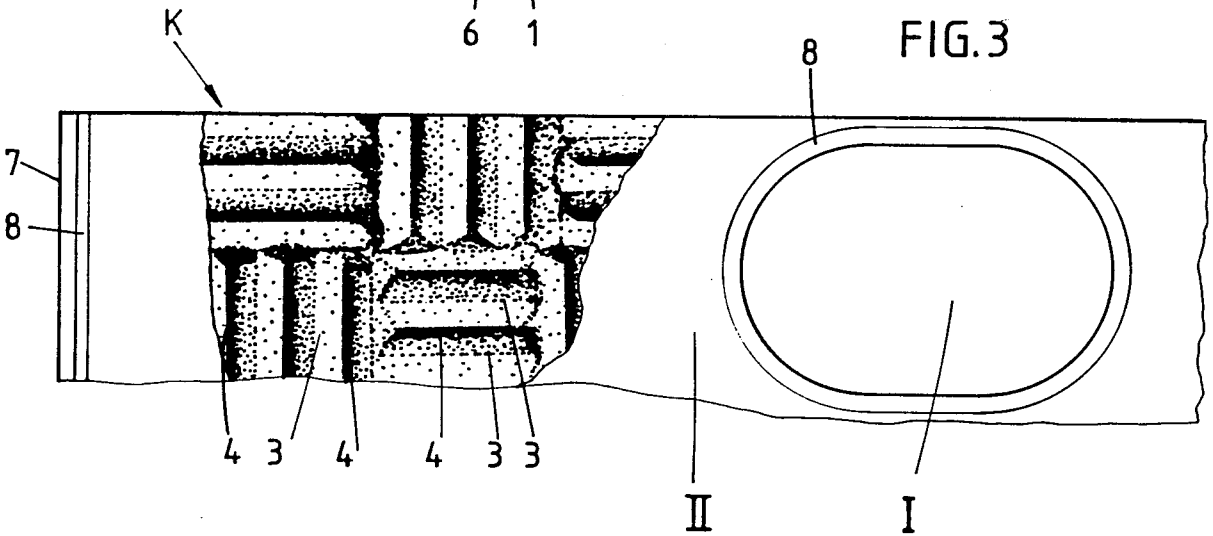
FIG. 3 is a top view of a portion of FIG. 2, partially broken away to show a profiled individual board.

The transition zone between the compressed regions I and the uncompressed regions II does not appear merely as a concave transition rounding; rather, an identically extending but flat oblique flank 8 is formed in the convex transition rounding (see FIGS. 2 and 3). This leads to an exact, wrinkle-free, not extremely notched transition.

I claim:

1. An acoustic insulating board formed of foam with a structured bulge-forming surface providing regions of differing thickness, the acoustic insulating board comprising a plurality of individual board elements placed one above the other, said board elements having regions of differing thickness wherein one thickness is smaller than another thickness, said board elements being compressed in regions of smaller thickness, the board elements being fused on surfaces thereof to each other in said regions of smaller thickness; and wherein said board elements in regions of larger thickness lie loosely on top of one another, such that a top side of one of said board elements facing in a direction of structure bulging is profiled in the regions of larger thickness, said one of said board elements being centrally located between other ones of said board elements.

2. An acoustic insulating board according to claim 1, wherein profiling of said one of said board elements comprises arrays of ribs and grooves disposed in fields which lie cross-wise to each other.

3. An acoustic insulating board according to claim 1, wherein a transition zone having a form of an oblique flank is arranged between said regions of larger and smaller thickness.

* * * * *